US008727519B2

(12) United States Patent
Nakagawa et al.

(10) Patent No.: US 8,727,519 B2
(45) Date of Patent: May 20, 2014

(54) INKJET PRINTING APPARATUS AND METHOD OF CONTROLLING INKJET PRINTING APPARATUS

(75) Inventors: Yoshinori Nakagawa, Kawasaki (JP); Yuji Hamasaki, Kawasaki (JP); Atsushi Takahashi, Kawasaki (JP); Nobuhiro Kitabatake, Kawasaki (JP); Kei Yoshizawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 13/217,520

(22) Filed: Aug. 25, 2011

(65) Prior Publication Data

US 2012/0050426 A1 Mar. 1, 2012

(30) Foreign Application Priority Data

Aug. 30, 2010 (JP) ..... 2010-192349

(51) Int. Cl.
*B41J 2/19* (2006.01)
*B41J 2/17* (2006.01)
*B41J 2/175* (2006.01)

(52) U.S. Cl.
USPC ..... 347/92; 347/84; 347/85

(58) Field of Classification Search
USPC ..... 347/6, 84, 85, 86, 92
See application file for complete search history.

(56) References Cited

U.S. PATENT DOCUMENTS 6,364,448 B2 * 4/2002 Nishioka et al. ..... 347/92
2008/0049084 A1 * 2/2008 Katada ..... 347/92
2009/0073201 A1 * 3/2009 Watanabe et al. ..... 347/9
2012/0050358 A1 3/2012 Kitabatake et al.
2012/0050421 A1 3/2012 Hamasaki et al.

FOREIGN PATENT DOCUMENTS

JP 08-207315 A 8/1996
JP 10-006531 A 1/1998
JP 2006-007493 A 1/2006
JP 2007-038656 A 2/2007
JP 2007-098570 A 4/2007
JP 2008-213494 A 9/2008

OTHER PUBLICATIONS

Office Action in Japanese Patent Application No. 2010-192349, dates Mar. 11, 2014.

* cited by examiner

*Primary Examiner* — Jannelle M Lebron
(74) *Attorney, Agent, or Firm* — Fitzpatrick, Cella, Harper & Scinto

(57) ABSTRACT

Provided are an inkjet printing apparatus and a method of controlling an inkjet printing apparatus whereby the performing of a suction discharge operation, for air bubbles that have penetrated inside an ink supply line, can be suppressed to a minimum necessary number of times, and whereby the ink discharge volume that accompanies air bubble suction discharge operations can be kept low. The volume of an air bubble that penetrates into an ink supply line is estimated on the basis of an elapsed time since the last air bubble suction discharge operation, and in addition, the volume of an air bubble that penetrates into the ink supply line during main tank installation is predicted. The suction discharge operation (choke suction operation) for suctioning out and discharging air bubbles is conducted when the sum of these estimated volumes becomes equal to or greater than a predetermined value.

19 Claims, 11 Drawing Sheets

| AMOUNT OF REMAINING INK | AIR BUBBLE VOLUME |
|---|---|
| 5g OR GREATER | 0.03cc |
| LESS THAN 5g AND 2g OR GREATER | 0.05cc |
| LESS THAN 2g AND 0.5g OR GREATER | 0.07cc |
| LESS THAN 0.5g | 0.2cc |

FIG.9

INKJET PRINTING APPARATUS AND METHOD OF CONTROLLING INKJET PRINTING APPARATUS

BACKGROUND OF THE INVENTION

1. Field of the Invention

The present invention relates to an inkjet printing apparatus that prints an image using ink supplied via an ink supply line from an ink tank, and also to a method of controlling such an inkjet printing apparatus.

2. Description of the Related Art

Among inkjet printing apparatuses that print an image onto a print medium by using a print head able to eject ink, there are apparatuses that supply ink to a print head via a tube or other ink supply pipe from an ink tank located at a position distanced from the print head. The inkjet printing apparatus that supplies ink via such an ink supply pipe has advantages such as increased freedom in ink tank placement, or easier enlargement of ink tank volume. However, since most elastic materials used for ink supply pipes have gas permeability properties, there is a risk that air bubbles may penetrate inside an ink supply pipe over long periods of use. In the case where such air bubbles accompany the flow of ink and flow into the interior of a print head, there is a risk of causing faulty ink ejection or other negative effects in the print head. For this reason, it is necessary to eliminate air bubbles that have penetrated into an ink supply pipe in this way.

As one method of discharging air bubbles inside an ink supply pipe, Japanese Patent Laid-Open No. H08-207315 (1996) describes a method that uses a configuration wherein ink inside a print head is forcibly suctioned out and discharged from a print head nozzle (a suction discharge operation). Namely, the elapsed time since the last suction discharge operation is measured, and the next suction discharge operation is performed when the measured time exceeds a fixed value. In so doing, air bubbles inside a print head are suctioned out and discharged together with ink.

In Japanese Patent Laid-Open No. H08-207315 (1996), only air bubbles that have permeated the material of an ink supply line are considered, and by managing time using a timer, air bubbles that have permeated and penetrated the material of the ink supply line are suctioned and discharged every time a fixed amount of time elapses. For this reason, the air bubble penetration volume cannot be ascertained with regard to air bubbles that are pushed in during ink tank installation or air bubbles whose penetration volume cannot be uniformly managed by time management only, and timings at which to perform suction discharge operations cannot be optimally set.

SUMMARY OF THE INVENTION

The present invention provides an inkjet printing apparatus and a method of controlling an inkjet printing apparatus whereby the performing of a suction discharge operation for air bubbles that have penetrated inside an ink supply line can be suppressed to a minimum necessary number of times and whereby the ink discharge volume that accompanies air bubble suction discharge operations can be kept low.

In the first aspect of the present invention, there is provided an inkjet printing apparatus that prints an image by using a print head able to eject ink, supplied from an ink tank via an ink supply line, from an ejection port, comprising:

an estimator configured to individually estimate air bubble penetration volumes by which air bubbles penetrate into the ink supply line for a plurality of penetration factors by which air bubbles penetrate into the ink supply line; and a suction discharge unit configured to suction out and discharge an air bubble inside the print head and inside the ink supply line by causing negative pressure to be exerted on the ejection port from the outside, when the sum of air bubble penetration volumes individually estimated for the plurality of penetration factors becomes equal to or greater than a predetermined volume.

In the second aspect of the present invention, there is provided a method of controlling an inkjet printing apparatus that prints an image by using a print head able to eject ink, supplied from an ink tank via an ink supply line, from an ejection port, comprising steps of:

individually estimating air bubble penetration volumes by which air bubbles penetrate into the ink supply line for a plurality of penetration factors by which air bubbles penetrate into the ink supply line; and suctioning and discharging an air bubble inside the print head and inside the ink supply line by causing negative pressure to be exerted on the ejection port from the outside, when the sum of air bubble penetration volumes individually estimated for the plurality of penetration factors becomes equal to or greater than a predetermined volume.

According to the present invention, an air bubble penetration volume is estimated for each of a plurality of penetration factors by which air bubbles penetrate into an ink supply line, and an air bubble suction discharge operation is conducted when the sum of these penetration volumes has become a given volume or more. For this reason, air bubbles inside an ink supply line can be suctioned and discharged by a minimum necessary number of suction discharge operations. As a result, faulty ink ejections or other negative effects in a print head due to air bubbles that have penetrated inside the ink supply line can be avoided and a high-quality image can be printed, while in addition, the volume of ink discharged along with air bubble suction discharges can be decreased.

Further features of the present invention will become apparent from the following description of exemplary embodiments (with reference to the attached drawings).

BRIEF DESCRIPTION OF THE DRAWINGS

FIG. 9 explains an air bubble volume table for estimating air bubble penetration volumes during main ink tank installation;

DESCRIPTION OF THE EMBODIMENTS

Hereinafter, embodiments of the present invention will be described in detail and with reference to the drawings.

First Embodiment

Figure 1:
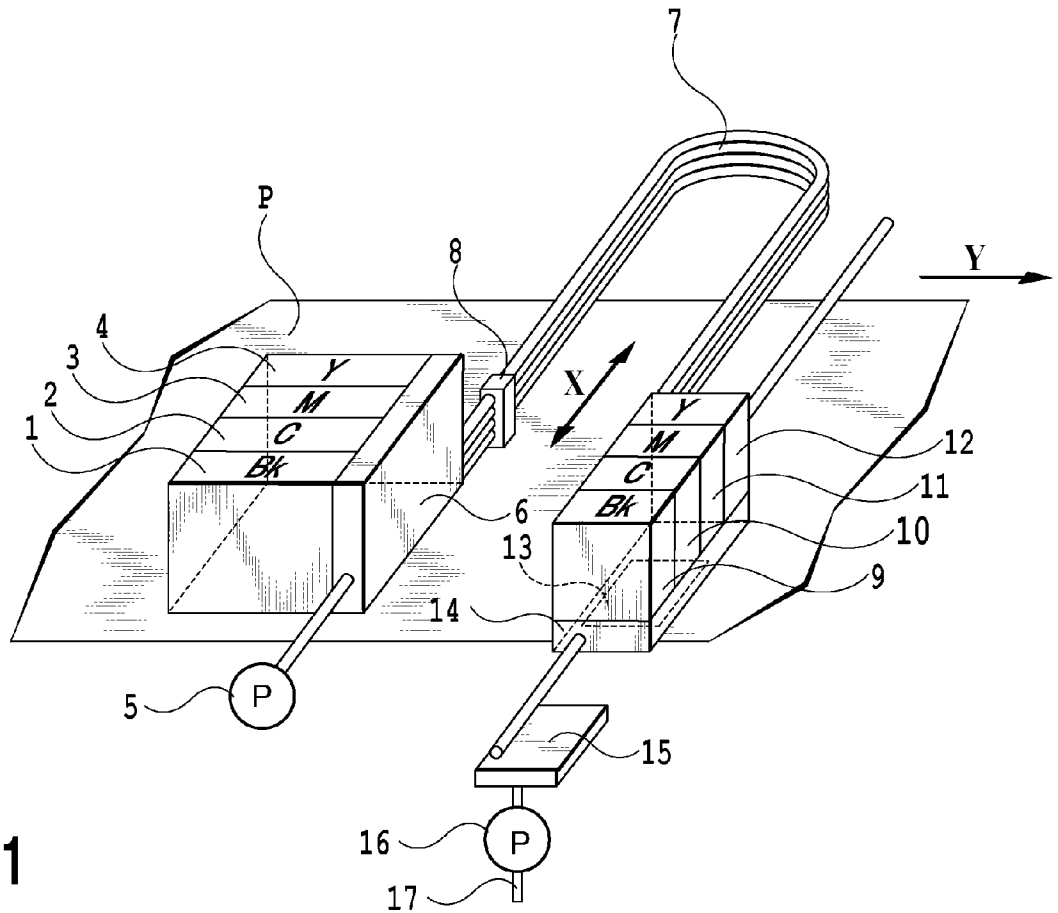
FIG. 1 is a perspective view of principal parts in a printing apparatus of a first embodiment of the present invention.

FIG. 1 is a schematic configuration of principal parts in an inkjet printing apparatus of the present invention.

In FIG. 1, reference numerals 1, 2, 3, and 4 denote main tanks in which black, cyan, magenta, and yellow ink are stored, respectively. As discussed later, the ink stored in these main tanks is pressurized by a pressure pump 5 and transferred via joints 6 into supply tubes 7 corresponding to each ink color. It is possible to individually make the supply tubes 7 corresponding to each ink color communicate or be shut off by an open-closed valve 8 provided upstream to the supply tubes 7. The downstream sides of the supply tubes 7 are joined to sub-tanks 9, 10, 11, and 12 corresponding to each ink color. These sub-tanks temporarily store their corresponding ink, and supply that ink to a print head 13 during printing operations and maintenance. The sub-tanks 9 to 12 and the print head 13 are installed on a carriage 14 which is bi-directionally moved in a main scan direction indicated by the arrow X by the driving force of a driving motor (not illustrated). A print medium P is conveyed in a sub scan direction indicated by the arrow Y by a conveyance mechanism (not illustrated). The sub scan direction intersects (and in the case of the present example, is orthogonal to) the main scan direction.

A plurality of nozzles able to eject ink are formed on the print head 13. These nozzles are formed such that nozzle lines corresponding to each ink color extend in a direction that intersects (and in the case of the present example, is orthogonal to) the main scan direction. Each respective nozzle is able to eject ink by using an electrothermal conversion element (heater) or piezo element. In the case of using the electrothermal converter, a bubble is formed in the ink due to the heat produced, and the bubble-forming energy can be used to eject ink from an ejection port at the nozzle tip.

By alternately repeating print scans, which eject ink from nozzles while the print head 13 moves in the main scan direction together with the carriage 14, and operations that convey a print medium P in the sub scan direction, an image can be successively printed onto the print medium P. In this way, the printing apparatus of the present example functions as what is called a serial scan printing apparatus. In the case where maintenance of the print head 13 is required, the carriage 14 moves to a position over a suction cap 15. The suction cap 15 can ascend and descend by a driving source (not illustrated), and by ascending during maintenance, the suction cap 15 fits tightly against and caps the nozzle formation surface of the print head 13 where the nozzles are formed. The suction cap 15 is joined to a suction pump 16, which is able to depressurize the inside of the suction cap 15 during suction recovery operations. By depressurizing the inside of the suction cap 15 with the suction pump 16, ink inside the print head 13 can be suctioned from the nozzles of the print head 13 and discharged inside the suction cap 15. In other words, by causing negative pressure to act on the ports at the nozzle tips from the outside, air bubbles inside the print head and inside the ink supply lines can be suctioned out and discharged together with ink. Suctioned and discharged ink is discharged and stored in a waste ink absorber (not illustrated) inside the inkjet printing apparatus via a discharge pipe 17.

According to such a suction and discharge operation, thickened ink and air bubbles inside the ink supply lines between the main tanks and the print head 13 and inside the print head 13 can be discharged. Furthermore, by causing the suction pump 16 to operate in a state where the open-closed valve 8 is closed, depressurization inside the ink supply lines from the main tanks to the print head 13 and inside the print head 13 can be increased, as discussed later.

Figure 2:
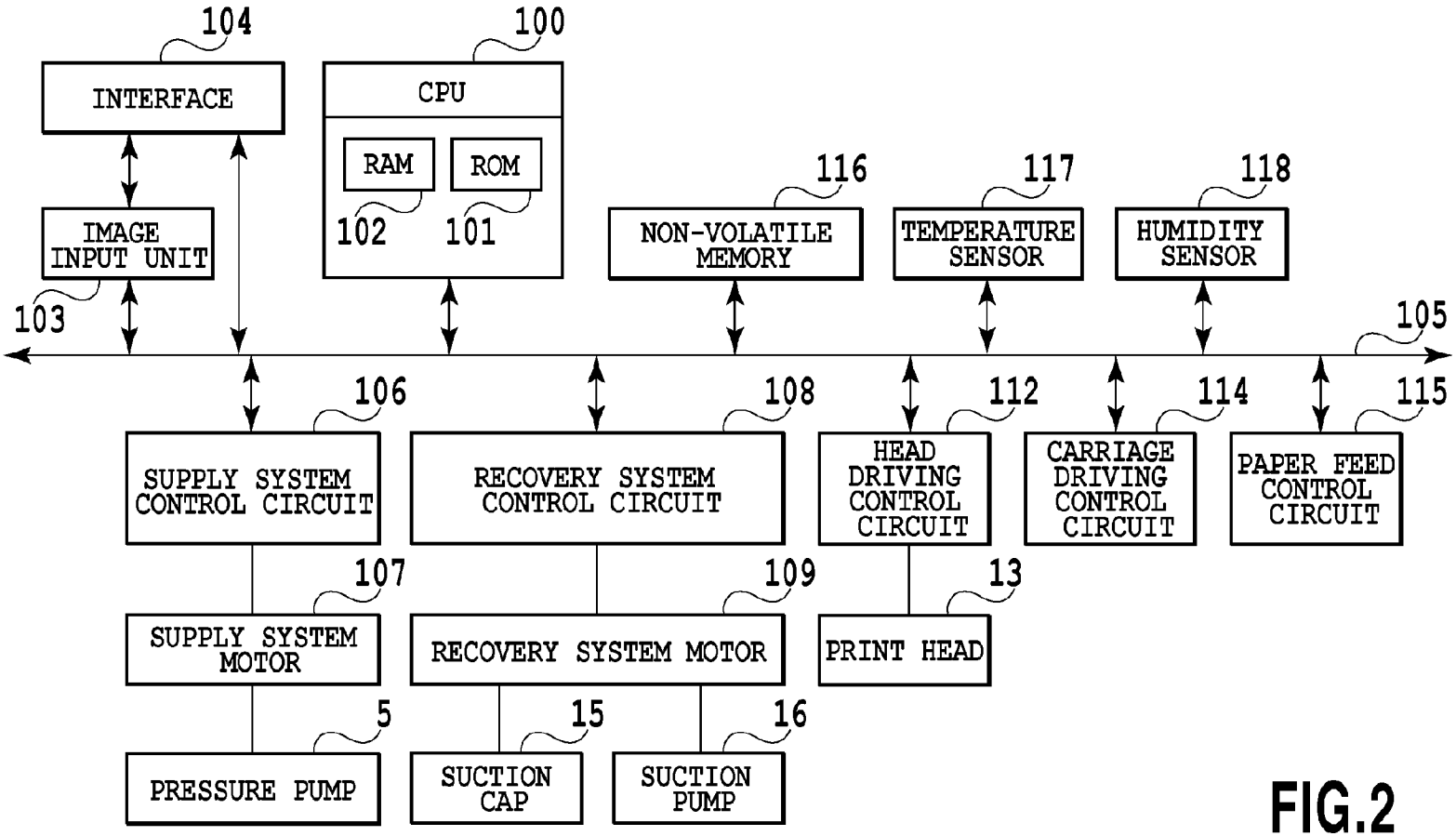
FIG. 2 is a block diagram of a control system in the printing apparatus in FIG. 1.

FIG. 2 is a block diagram of a control system in the printing apparatus of the present example.

A CPU 100 controls respective parts of the apparatus and executes data processing via a main bus line 105. In other words, the CPU 100, following a program stored in ROM 101, executes printing operations by controlling data processing, driving of the print head, and driving of the carriage. The CPU 100 is able to communicate with an external host apparatus via an interface 104. As discussed later, a process that estimates air bubble penetration volumes for individual air bubble penetration factors and a process that controls a suction discharge operation on the basis of those estimated air bubble penetration volumes can be executed under control by the CPU 100. Also, at least part of these processes may also be executed by the external host apparatus coupled via the interface 104. RAM 102 is used as a work area for data processing, etc. by the CPU 100. Also, the RAM 102 can temporarily save information such as print data for a plurality of scans, parameters related to recovery operations (including suction discharge operations) for maintaining a good ink ejection state in the print head, and parameters related to ink supply operations. An image input unit 103 temporarily holds an image input from the host apparatus via the interface 104. Non-volatile memory 116 stores an operational history of the printing apparatus, including the times at which recovery process operations were conducted and their number, etc.

A reference numeral 117 denotes a temperature sensor and a reference numeral 118 denotes a humidity sensor which detect the temperature and humidity of the environment in which the printing apparatus is placed, with the detection results being processed as control factors for ink ejection operations from the print head and recovery operations of the print head. A supply system control circuit 106 follows a supply process program stored in the RAM 102 to control a supply system motor 107, which causes the pressure pump 5 to operate. By the operation of the pressure pump 5, ink inside the main tanks is pressurized as discussed earlier. A recovery system control circuit 108 follows a recovery process program stored in the RAM 102 to control a recovery system motor, which executes a recovery process operation by the ascending and descending of the suction cap 15 and the suction pump 16 discussed earlier. A head driving control circuit 112 causes ink to be ejected from the print head 13 in order to print an image (ink ejection operations). A carriage driving control circuit 114 controls movement of the carriage 14 in the main scan direction in accordance with print data input from the image input unit 103.

Figure 3:
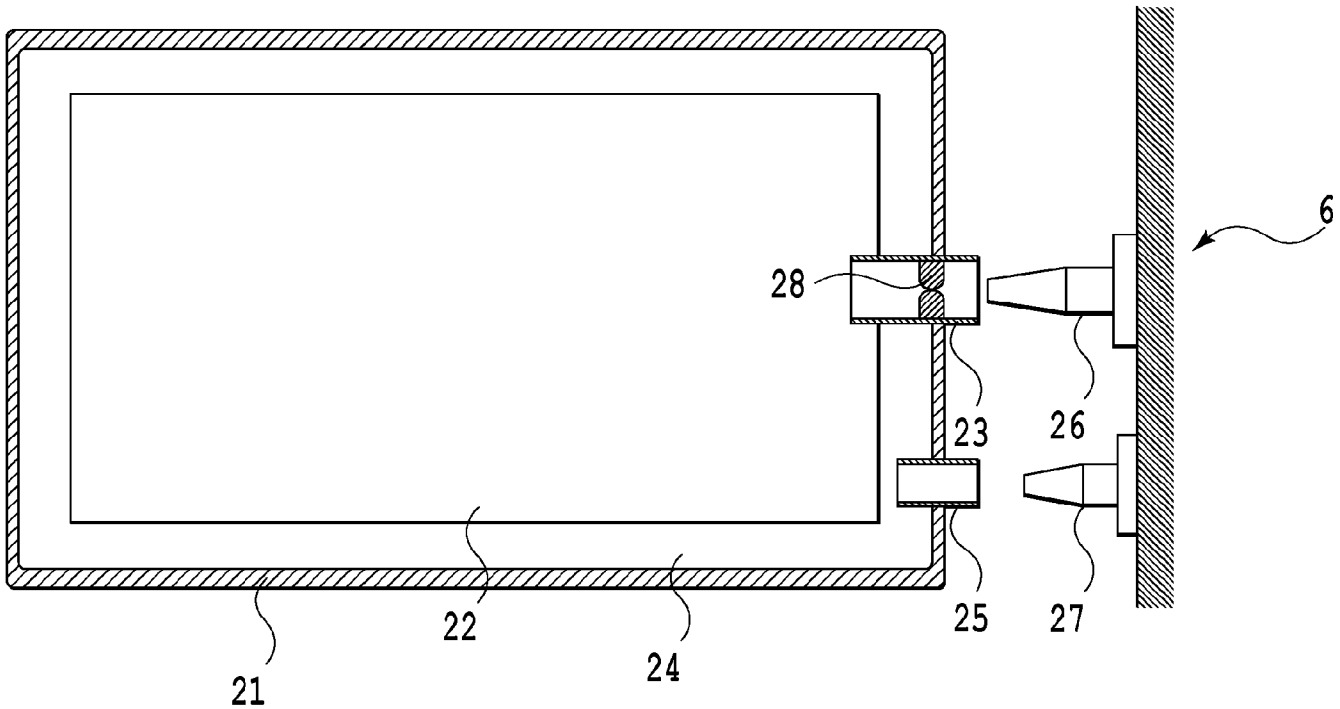
FIG. 3 is a cross-sectional view of the ink tank in FIG. 1.

FIG. 3 is a cross-sectional view for explaining the relationship between the main tanks 1 to 4 and the joints 6 on the printing apparatus side. In FIG. 3, a representative relationship between one main tank 1 from among the main tanks 1 to 4 and its corresponding joint 6 is illustrated. The relationships between other main tanks and their corresponding joints are similar.

The main tank 1 is configured to house an ink pack 22 inside a main tank enclosure 21, and is able to supply ink inside the ink pack 22 into the printing apparatus via an ink communication pipe 23. The ink communication pipe 23 is supported by the main tank enclosure 21, and communicates with a supply tube 7 (see FIG. 1), which forms the ink supply line of the printing apparatus, by jointing with an ink joint 26. When the ink communication pipe 23 and the ink joint 26 are not jointed (the non-joint time), the inside of the ink communication pipe 23 is sealed by a sealing member 28 formed out of an elastic material such that black ink inside the ink pack does not leak out. A pressurized space 24 formed between the main tank enclosure 21 and the ink pack 22 communicates with a communication port 25, while the communication port 25 communicates with the pressure pump 5 inside the printing apparatus (see FIG. 2) by jointing with an air joint 27. When the pressure pump 5 is made to operate, air is introduced inside the pressurized space 24 and the ink pack 22 is pressurized. Due to this pressurizing force, ink inside the ink pack 22 is pushed out via the ink communication pipe 23 and the ink joint 26 and supplied to the print head. The pressure pump 5 communicates with the atmosphere when pressurization is not required, and the interior of the pressurized space 24 can be equalized with atmospheric pressure. By additionally housing ink packs constituting the other main tanks 2 to 4 inside a main tank enclosure 21 and introducing air into a pressurized space 24, the cyan, magenta, and yellow inks inside those ink packs can be similarly supplied.

Figure 4A:
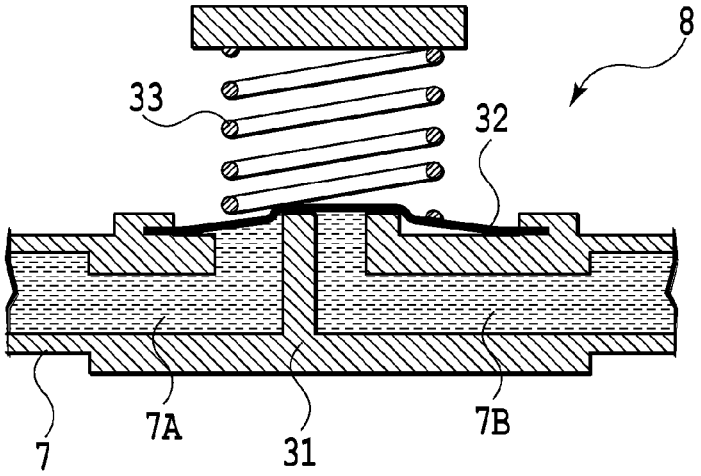
FIGS. 4A and 4B are respective cross-sectional views during different operations of an open-closed valve in FIG. 1.
Figure 4B:
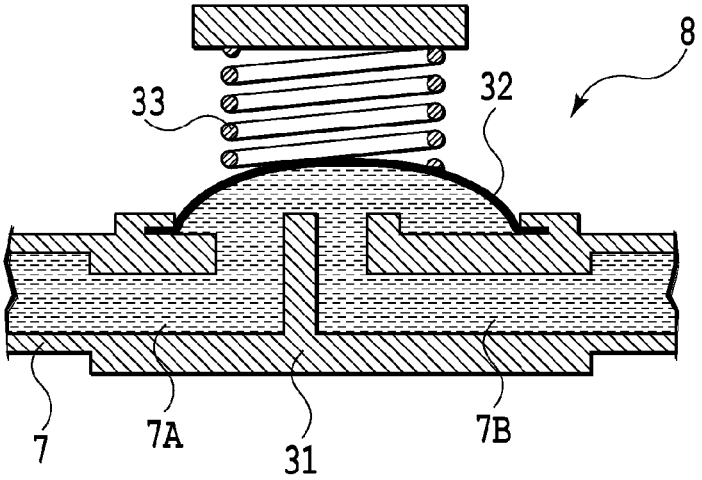

FIGS. 4A and 4B are cross-sectional views for explaining a representative example of an open-closed valve part able to communicate or shut off a single supply tube 7 in the open-closed valve 8 or able to communicate or shut off the four supply tubes 7 corresponding to each ink color (see FIG. 1). FIG. 4A represents a state where the open-closed valve part is closed, while FIG. 4B represents a state where the open-closed valve part is open Ink supplied from the main tank flows into the open-closed valve part via the supply tube 7. The open-closed valve part includes a body 31 that forms a channel coupled to the supply tube 7, and a diaphragm valve 32 formed with an elastic material, with the edges of the diaphragm valve 32 being affixed to the body 31. In the body 31, an upstream channel 7A that communicates with the upstream portion of the supply tube 7 in the ink supply direction, and a downstream channel 7B that communicates with the downstream portion of the supply tube 7 in the ink supply direction are formed. These channels 7A and 7B are open at positions facing the diaphragm valve 32. The diaphragm valve 32 is urged downward in FIG. 4A by a spring member 33. When ink inside the upstream channel 7A is not being pressurized by the pressure pump 5, the diaphragm valve 32 blocks the apertures of the channels 7A and 7B due to the urging force of the spring member 33, as in FIG. 4A. At this point, the open-closed valve part is in a closed state. In contrast, when ink inside the upstream channel 7A is pressurized by the pressure pump 5, the diaphragm valve 32 resists the urging force of the spring member 33 and deforms so as to open the apertures of the channels 7A and 7B, as in FIG. 4B. In so doing, the open-closed valve part enters an open state and forms an ink channel between the upstream channel 7A and the downstream channel 7B.

Figure 5A:
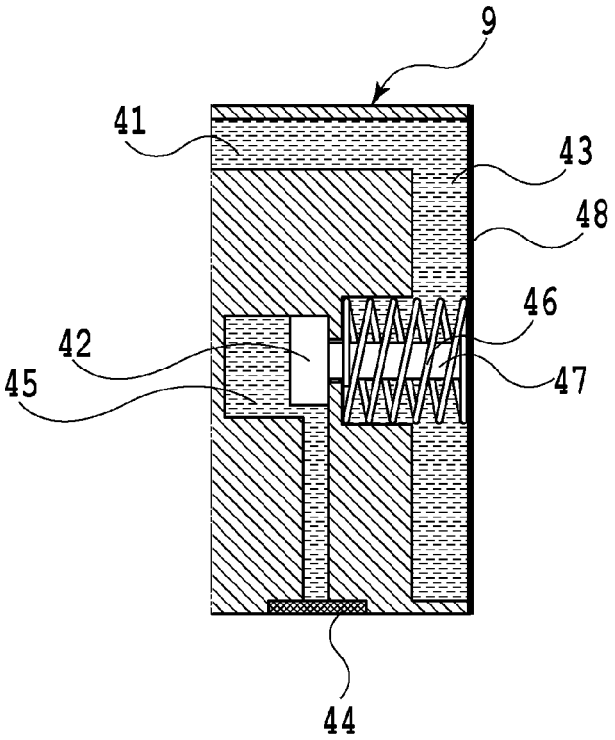
FIGS. 5A and 5B are respective cross-sectional views during different operations of a sub-tank in FIG. 1.
Figure 5B:
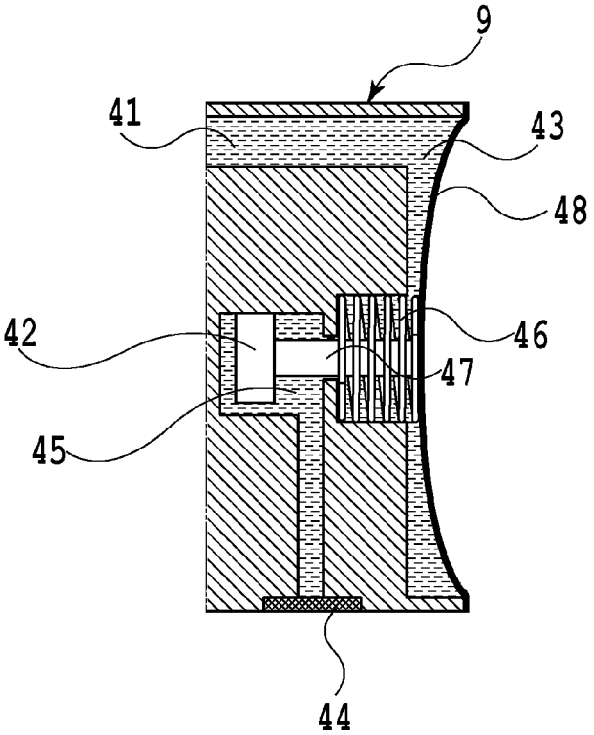

FIGS. 5A and 5B are cross-sectional views for explaining a representative example of a configuration of a single sub-tank 9 among the four sub-tanks 9 to 12. The other sub-tanks are similarly configured. Ink supplied via the supply tube 7 flows into the sub-tank 9 from an inflow port 41, and is then supplied to the print head 13 via a filter 44. Two facing chambers separated by a supply restriction valve 42 are formed in the sub-tank 9. One chamber is an ink chamber 43 on the side of the inflow port 41, while the other chamber is a negative pressure chamber 45 on the side of the filter 44, where constant negative pressure is maintained. The supply restriction valve 42 is joined to one end of a support rod 47, while the other end of the support rod 47 is joined to a sheet 48 formed with a flexible member. The sheet 48 is adhered to the sub-tank 9 so as to block all aperture parts in the sub-tank 9 other than the inflow port 41 and the filter 44. A spring member 46 provided inside the ink chamber 43 urges in a direction causing the volume of the ink chamber 43 to expand, or in other words, towards the sheet 48 on the right side of FIG. 5A. For this reason, the supply restriction valve 42 is normally in a closed state isolating the ink chamber 43 and the negative pressure chamber 45 as in FIG. 5A.

In the case where ink is expended via the filter 44 and negative pressure rises inside the negative pressure chamber 45 during printing operations and maintenance operations (including suction discharge operations), etc., the supply restriction valve 42 opens and the ink chamber 43 and the negative pressure chamber 45 communicate with each other, as in FIG. 5B. As a result, ink inside the ink chamber 43 flows into the negative pressure chamber 45 due to the differential pressure between the ink chamber 43 and the negative pressure chamber 45. As ink flows into the negative pressure chamber 45 and the differential pressure between the ink chamber 43 and the negative pressure chamber 45 decreases, the supply restriction valve 42 once again enters the closed state due to the urging force of the spring member 46, as in FIG. 5A. Since the supply restriction valve 42 enters the closed state due to the urging force of the spring member 46 before the inside of the negative pressure chamber 45 reaches positive pressure, the pressure inside the negative pressure chamber 45 is maintained at constant negative pressure.

As discussed later, the ink supply line reaching from the main tank to the sub-tank includes air bubbles penetrating from the outside through the walls of the supply tube 7 and air bubbles that are pushed in during ink tank installation. If such air bubbles penetrate into the ink supply line and reach the print head, there is a risk that the print head may become unable to eject ink normally, and desired printing may not be possible. In the present example, a suction discharge operation (also called a "choke suction operation") is executed in order to eliminate air bubbles that have penetrated inside the ink supply line in this way.

Figure 6:
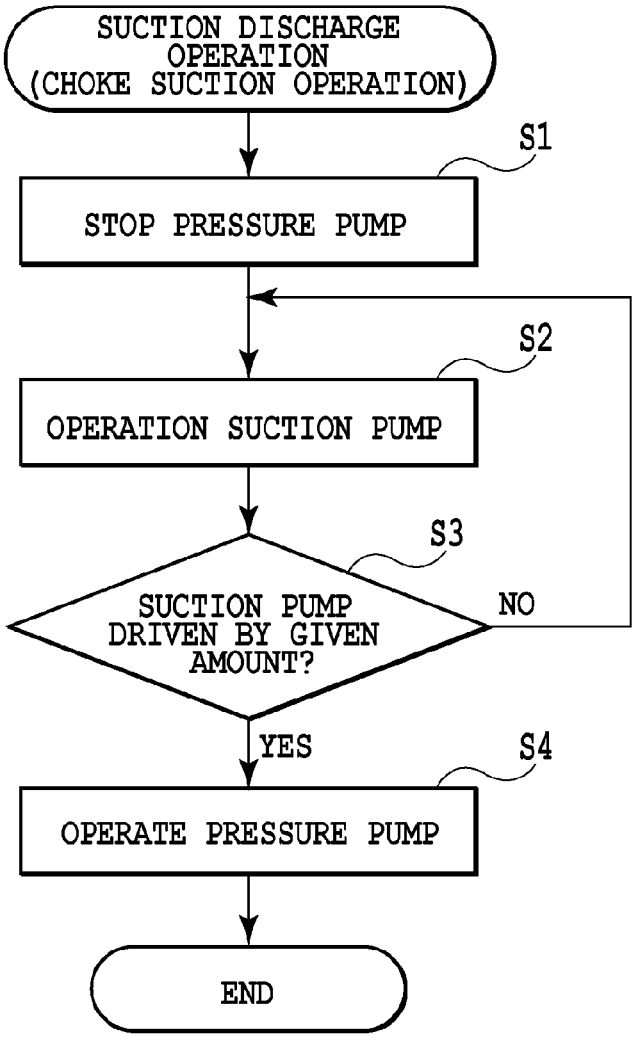
FIG. 6 is a flowchart for explaining a suction discharge operation in the first embodiment of the present invention.

FIG. 6 is a flowchart for explaining the choke suction operation.

First, in step S1 the pressure pump 5 is stopped, and pressurization inside the ink supply line is canceled. In so doing, the open-closed valve 8 enters the closed state as in FIG. 4A. In the next step S2, the suction operation by the suction pump 16 is initiated, and as discussed earlier, ink inside the print head 13 is suctioned out from nozzles and discharged into the suction cap 15. By conducting such a suction operation with the open-closed valve 8 in the closed state, negative pressure inside the sub-tank increases. As a result, the supply restriction valve 42 opens as in FIG. 5B, and the ink supply line reaching from the open-closed valve 8 into the print head 13 enters a negative pressure state. In step S3, it is determined whether or not the suction pump 16 has been driven a given amount. This given amount is the required amount to drive the suction pump 16 until the ink supply line reaches a desired negative pressure, and may be a preset driving amount, or the driving amount until a desired negative pressure is detected using a negative pressure sensor (not illustrated) inside the ink supply line. The driving of the suction pump 16 is continued until driven by the given amount.

After the suction pump 16 has been driven the given amount, in step S4 operation of the pressure pump 5 is initiated. Due to the pressure pump 5 operating, the open-closed valve 8 enters the open state as in FIG. 4B, and ink from the main tank flows into the ink supply line. This ink flows into the sub-tank via the supply tube 7 and the negative pressure inside the sub-tank is alleviated, thus causing the supply restriction valve 42 to once again enter the closed state as in FIG. 5A. Due to the supply restriction valve 42 entering the closed state in this way, the ink discharge operation from the nozzles of the print head 13 is stopped, and the choke suction operation ends.

Figure 7A:
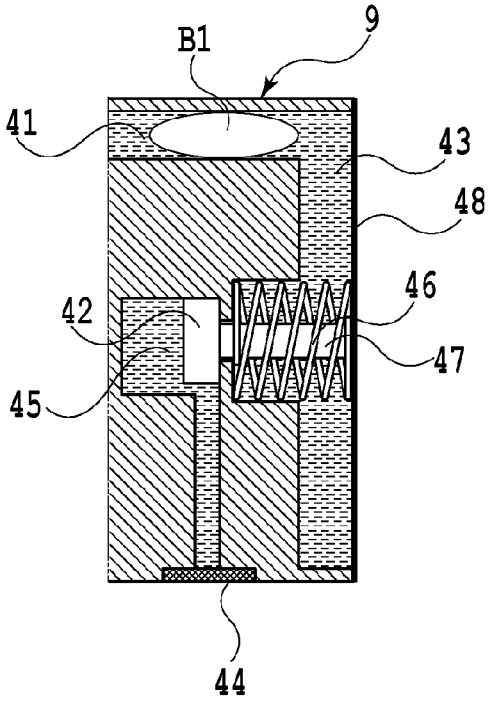
FIGS. 7A, 7B and 7C are respective cross-sectional views of the sub-tank during the suction discharge operation in FIG. 6.
Figure 7B:
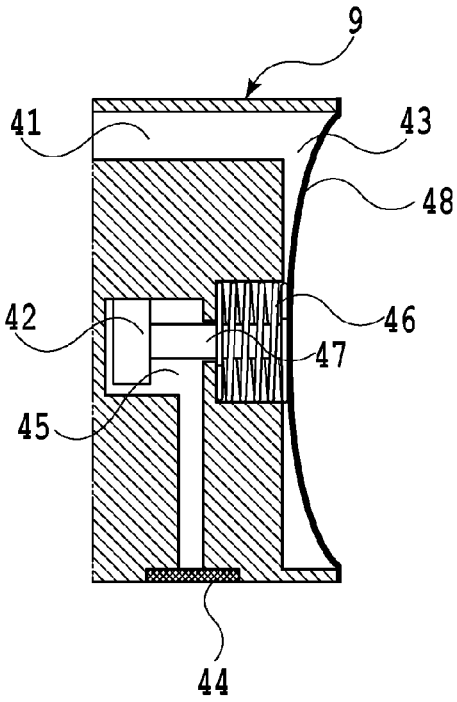
Figure 7C:
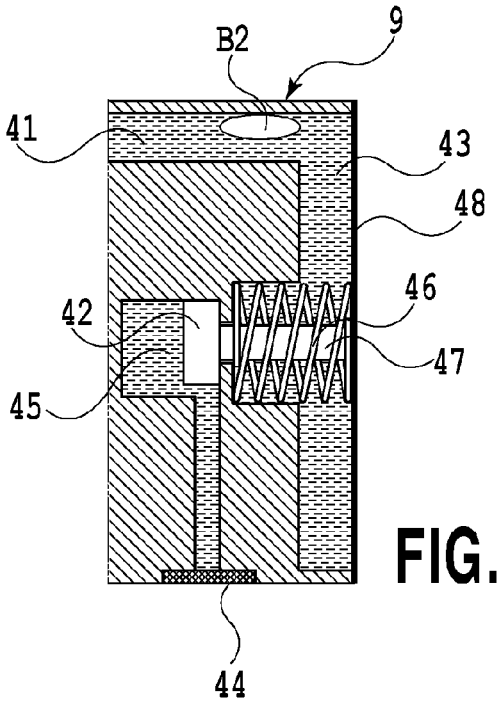

FIGS. 7A, 7B and 7C explain state transitions of air bubbles inside the sub-tank during such a choke suction operation.

FIG. 7A represents a state of air bubbles inside the sub-tank before initiating the choke suction operation. In the upper part of the sub-tank, there resides an air bubble B1 that has entered into the ink supply line on the way from the main tank to the sub-tank. FIG. 7B represents a state inside the sub-tank during the choke suction operation. According to the choke suction operation, once pressurization inside the ink supply line by the pressure pump 5 is canceled (step S1) and the suction pump 16 initiates operation (step S2), negative pressure inside the negative pressure chamber 45 rises, and the supply restriction valve 42 opens as in FIG. 7B. Synchronized with the opening of the supply restriction valve 42, the sheet 48 bends due to the negative pressure inside the negative pressure chamber 45 in a direction causing the volume of the ink chamber 43 to decrease (leftward in FIG. 7B). Furthermore, due to the suction pump 16 operating (steps S2 and S3), negative pressure rises inside the ink supply line, including inside the ink chamber 43, and the air bubble B1 swells due to this negative pressure. At this point, since the inside of the sub-tank is depressurized to approximately 0.5 atm, the air bubble B1 swells to double volume. Due to the volume reduction inside the ink chamber 43 and the volume expansion of the air bubble B1, the inside of the sub-tank enters a state of being almost completely filled by the swollen air bubble as in FIG. 7B. The swollen air bubble, unable to be contained inside the sub-tank, passes through the filter 44 and is suctioned out from the nozzles of the print head 13 and discharged.

FIG. 7C represents a state inside the sub-tank after causing the pressure pump 5 to operate (step S4) once the suction pump 16 has reached the given pump driving amount. Due to the operation of the pressure pump 5, ink is supplied from the main tank into the ink chamber 43 of the sub-tank. The ink flow produced at this point causes the air bubble inside the sub-tank to pass through the filter 44 and be suctioned out from the nozzles of the print head 13 and discharged. At this point, a residual air bubble B2 is also produced. However, this air bubble B2 has less volume than the air bubble B1 before the choke suction operation, and is no longer of a magnitude sufficient to adversely affect ink ejection by the print head. Negative pressure inside the ink chamber 43 decreases due to the ink supplied into the ink chamber 43, the supply restriction valve 42 once again enters the closed state due to the urging force of the spring member 46 as in FIG. 7C, and the choke suction operation ends.

Due to the choke suction operation like the above, the air bubble residing inside the sub-tank or the air bubble residing inside the ink supply line in the vicinity of the sub-tank can be suctioned out from the nozzles of the print head and discharged. Since ink is also discharged together with air bubbles in the choke suction operation, it is preferable to limit the number of times the operation is executed to the minimum necessary number. Thus, in the present embodiment, the total air bubble volume inside the ink supply line is estimated, and the choke suction operation is conducted only in the case where the air bubble volume has exceeded a given value. The method for estimating air bubble volume inside the ink supply line may be taken to involve computing penetration air bubble volumes for individual air bubble penetration factors, and taking their sum to be the total air bubble volume.

Hereinafter, a method for estimating air bubble volume inside an ink supply line will be explained.

One example of a factor by which air bubbles penetrate into an ink supply line is the factor by which air bubbles penetrate from the outside through the walls of an ink supply line such as a supply tube 7 (first penetration factor). The volume A of air bubbles penetrating from the outside through the walls of the ink supply line in this way can be estimated on the basis of the elapsed time since the choke suction operation was last conducted. In other words, the elapsed time from the time when the choke suction operation was last conducted up to the current time is measured by a timer, and the air bubble volume A is predicted according to the following equation 1 based on the measured time "T" and the air bubble penetration volume per unit time "a" in which air bubbles penetrate from the outside through the walls of the ink supply line.

$$A=T\times a \tag{1}$$

Figure 8A:
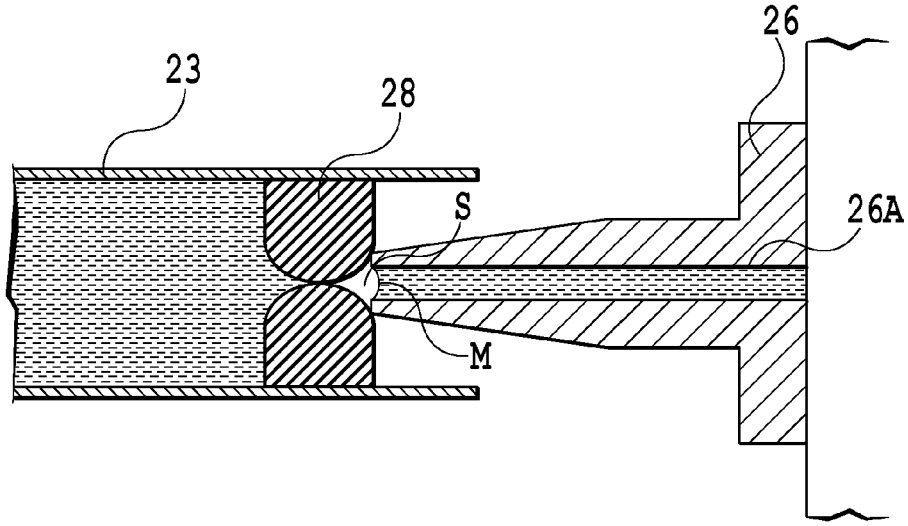
FIGS. 8A and 8B are respective cross-sectional views for explaining air bubbles that are pushed in during main tank installation.
Figure 8B:
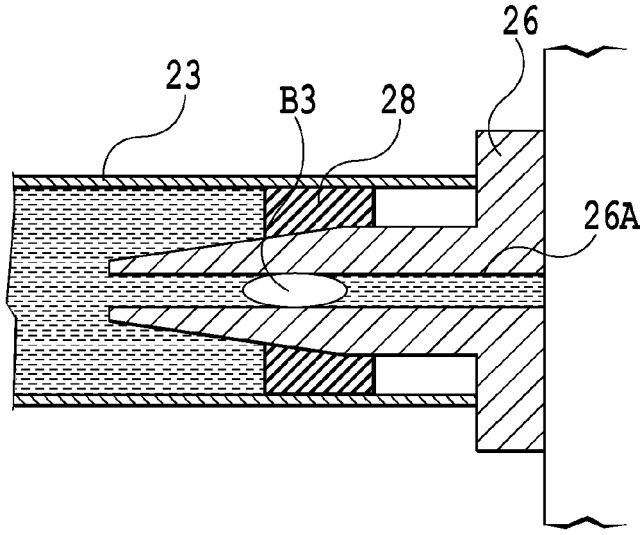

Another example of a factor by which air bubbles penetrate into the ink supply line is the factor by which air bubbles are pushed in during main tank installation (second penetration factor). FIGS. 8A and 8B explain air bubbles pushed in during ink tank installation. FIG. 8A represents the relationship between the ink communication pipe 23 (the connecting part on the side of the ink tank) and the ink joint 26 (the connecting part on the side of the ink supply line) before jointing with the main tank. FIG. 8B represents the relationship between the ink communication pipe 23 and the ink joint 26 after jointing with the main tank.

In FIG. 8A, the inside of the ink channel 26A of the ink joint 26 is filled with ink, and the an ink meniscus M is formed at the tip of the ink channel 26A so as to bow inward towards the inside of the ink channel 26A in a concave shape. When installing the main tank, the ink joint 26 contacts the sealing member 28, and a closed space S is formed between the sealing member 28 and the meniscus M. In FIG. 8B, gas inside the closed space S (air inside the closed space) penetrates into the ink channel 26A due to the ink joint 26 being inserted inside the ink communication pipe 23, and an air bubble B3 is formed. The volume of this air bubble B3 can be estimated on the basis of the amount of remaining ink inside the main tank, as discussed later. For this reason, an air bubble volume table associating amounts of remaining ink inside the main tank with volumes of air bubbles that penetrate during main tank installation is stored in the ROM 101 in the printing apparatus (see FIG. 2), as in FIG. 9. As the amount of remaining ink inside the main tank decreases, the ink pack 22 storing ink bends due to the weight of ink inside, and negative pressure is produced inside. Furthermore, a large negative pressure is additionally produced inside the ink supply line when ink inside the ink supply line is used for printing operations after the ink inside the main tank has been used up. For this reason, when such a main tank is removed, the meniscus M retreats inward into the ink supply line due to the large negative pressure inside the ink supply line, and a correspondingly large closed space S is formed. Consequently, when subsequently installing the main tank, the penetrating air bubble B3 becomes larger in accordance with the size of the closed space S. In FIG. 9, when the amount of remaining ink inside a previously removed main tank is less than 0 g, the volume increases for an air bubble that penetrates during installation of a subsequently installed main tank. The relationship between such amounts of remaining ink and air bubble volumes is an inversely proportional relationship.

The volume B of an air bubble that penetrates during installation of a main tank (hereinafter also called the "next main ink tank") can be estimated on the basis of the amount of remaining ink in a main tank (hereinafter also called the "last main ink tank") that was removed from the ink channel before installing the next ink tank. In other words, air bubble volumes b1, b2, b3, . . . , corresponding to the amount of remaining ink in the last main ink tank are computed from the air bubble volume table in FIG. 9 every time a main ink tank is installed. The air bubble volume B can then be estimated by summing those air bubble volumes b1, b2, b3, . . . , as in the following equation 2. In the case where the same main ink tank is re-installed multiple times, the last main tank and the next main tank become the same.

$$B=b1+b2+b3+ \quad (2)$$

In the present embodiment, the previously discussed choke suction operation is executed when the sum of these air bubble volumes A and B has exceeded a prescribed value. The prescribed value is the volume obtained by subtracting the residual air bubble volume in the ink supply line during initial ink filling and after the choke suction operation from the air bubble volume that can be held inside the sub-tank.

Figure 10:
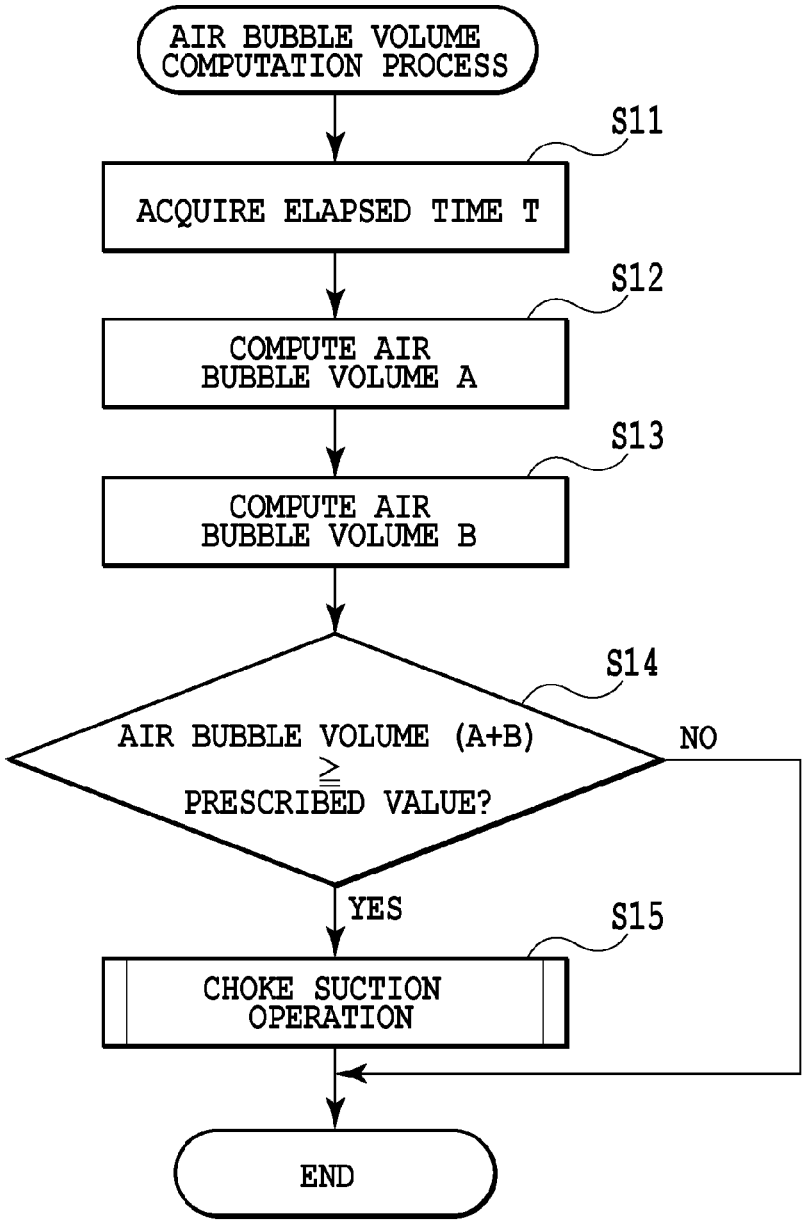
FIG. 10 is a flowchart for explaining an air bubble volume computation process in the first embodiment of the present invention.

FIG. 10 is a flowchart for explaining an air bubble volume computing process.

First, in step S11, the elapsed time T since the choke suction operation was last conducted is acquired, and in step S12, the air bubble volume A is computed according to the above equation 1. In the next step S13, the air bubble volume B is computed according to the above equation 2. After that, the sum of the air bubble volumes A and B is compared to the previously discussed prescribed value. When the value of the former is equal to or greater than the value of the latter, the choke suction operation is executed in step S15. When the value of the former is less than the value of the latter, the process ends without executing the choke suction operation. In other words, the choke suction operation is executed upon the condition of the sum of the air bubble volumes A and B being equal to or greater than the predetermined volume.

As above, penetrating air bubble volumes are estimated for individual air bubble penetration factors for the ink supply line, and when the sum of those air bubble volumes reaches a volume requiring an air bubble discharge operation (choke suction operation), that discharge operation (choke suction operation) is conducted. As a result, by conducting the necessary minimum number of air bubble discharge operations, adverse effects on printing operations due to air bubble penetration can be avoided, while the volume of ink discharged together with air bubbles can be kept low.

Second Embodiment

Figure 11A:
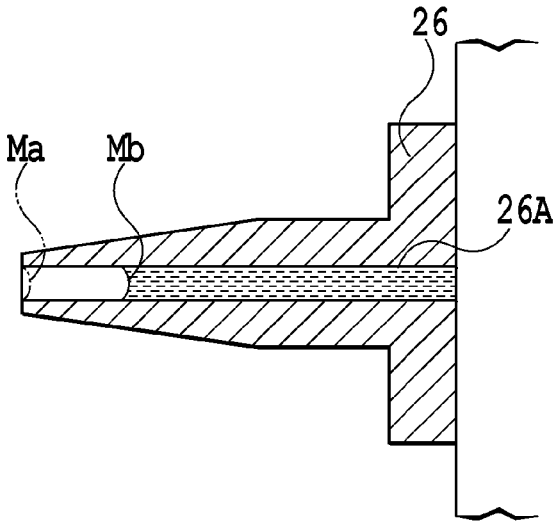
FIGS. 11A and 11B are respective cross-sectional views for explaining air bubbles that are pushed in during ink tank installation due to ink evaporation from an ink joint.
Figure 11B:
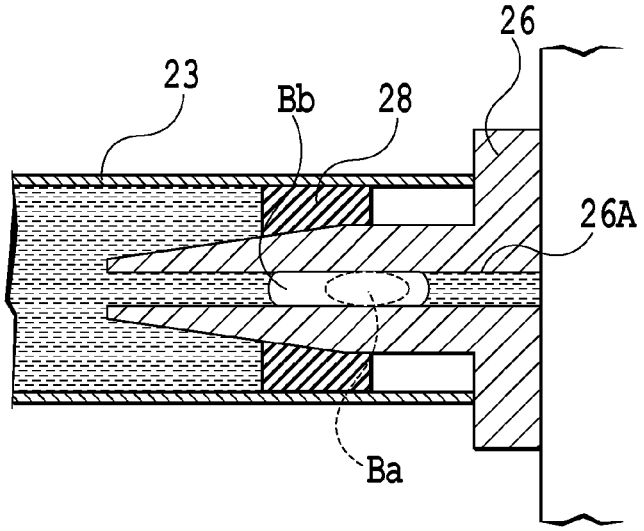

One type of air bubble that penetrates into the ink supply line is an air bubble that penetrates as ink evaporates from the joint of the ink supply line while the main tank is not installed. FIG. 11A represents a state where ink inside the ink channel 26A has evaporated from the aperture of the ink joint 26 from which the main tank has been removed. FIG. 11B represents a state when the main tank is installed onto the ink joint 26 in the state of FIG. 11A.

In FIG. 11A, reference mark Ma denotes a meniscus formed before ink inside the ink channel 26A evaporates, like the case of the previously discussed FIG. 8B. The meniscus Ma is positioned at the tip of the ink channel 26A. Since the main tank has been removed from the ink joint 26 and the tip of the ink joint 26 is exposed to the atmosphere, ink inside the ink channel 26A evaporates. As the ink evaporates, the volume of ink inside the ink channel 26A decreases, and the meniscus position retreats. Reference mark Mb indicates a retreated meniscus due to ink evaporation.

When the main tank is installed as in FIG. 11B, gas in the closed space formed between the meniscus and the sealing member 28 penetrates into the ink channel 26A and an air bubble is formed, similarly to the case of FIG. 8B discussed earlier. Reference mark Ba indicates an air bubble that penetrates into the ink channel 26A due to main tank installation, before the ink inside the ink channel 26A evaporates. Reference mark Bb indicates an air bubble that penetrates into the ink channel 26A due to main tank installation, after the meniscus Mb has retreated as in FIG. 11A. The latter air bubble Bb is larger than the former air bubble Ba. In the case where "Tc" is taken to be the non-installed time of the main tank (the period during which the main tank is not installed), and "c" is taken to be the ink evaporation volume per unit time from the aperture of the ink channel 26A, the volume differential "C" between the air bubbles Ba and Bb can be computed according to the following equation 3.

$$C=Tc\times c \quad (3)$$

The ink evaporation volume per unit time c is affected by the temperature and humidity of the environment in which the printing apparatus is placed. For this reason, the ink evaporation volume per unit time "c" is determined according to the detection results of the temperature sensor 117 and the humidity sensor 118 inside the printing apparatus.

In the present embodiment, the air bubble volume C is computed in addition to the air bubble volumes A and B in the first embodiment discussed earlier, and the choke suction operation is executed when their sum becomes equal to or greater than a prescribed value. Similarly to the case of the first embodiment, the prescribed value in this case is the value obtained by subtracting the residual air bubble volume in the ink supply line during initial ink filling and after the choke suction operation from the air bubble volume that can be held inside the sub-tank.

Third Embodiment

Another penetration factor by which air bubbles penetrate into the ink supply line is the factor by which dissolved gas in ink separates out to form an air bubble (third penetration factor). The temperature rises once ink is supplied from the main tank to the ink supply line, and when gas dissolved in the ink exceeds a saturation point, the gas separates out inside the ink supply line as an air bubble. The volume that separates out as an air bubble (air bubble volume) D can be estimated from the volume of the ink supply line and the temperature rise since the last suction discharge operation (the temperature rise from the temperature during the last suction operation to the current temperature). The volume of the ink supply line is fixed. Consequently, an air bubble separation volume table associating temperature rises and air bubble volumes D is stored in ROM 101 inside the printing apparatus (see FIG. 1). The air bubble volume D corresponding to the temperature rise can be computed from this air bubble separation volume table. The temperature rise of ink can be directly acquired by using a temperature sensor that detects the temperature of ink inside the ink supply line, or indirectly acquired by using a temperature sensor that detects the ambient temperature of the printing apparatus, for example.

In the present embodiment, the air bubble volume D corresponding to the temperature change is computed in addition to the air bubble volumes computed in the first and second embodiments discussed earlier, and the choke suction operation is executed when their sum becomes equal to or greater than a prescribed value set as the air bubble volume that can be held in the sub-tank.

Other Embodiments

The present invention may be widely applied not only to the serial scan printing apparatus discussed above, but also to various types of printing apparatus, such as full-line type printing apparatus which use a long print head extending across the entire horizontal print area in the printing medium. The configuration of ink supply lines is arbitrary, and is not necessarily limited to a specific configuration that includes elastic supply tubes. Also, it is not strictly necessary to provide the sub-tank along the ink supply line.

Also, the present invention is able to estimate air bubble penetration volumes according to at least two penetration factors from among the first, second, and third air bubble penetration factors discussed above, and execute the suction discharge operation when their sum becomes equal to or greater than a given volume. The present invention may also respectively estimate air bubble penetration volumes according to a plurality of penetration factors which include the first, second, and third air bubble penetration factors discussed above, and execute the suction discharge operation when their sum becomes equal to or greater than a given volume.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-192349, filed Aug. 30, 2010, which is hereby incorporated by reference herein in its entirety.

What is claimed is:

1. An inkjet printing apparatus that prints an image by using a print head able to eject ink, supplied from an ink tank via an ink supply line, from an ejection port, comprising:

an estimator configured to individually estimate air bubble penetration volumes due to air bubbles penetrating into the ink supply line, the estimator estimating the air bubble penetration volumes based on a plurality of penetration factors by which air bubbles penetrate into the ink supply line; and a suction discharge unit configured to suction out and discharge an air bubble inside the print head and/or inside the ink supply line by causing negative pressure to be exerted on the ejection port from the outside, when the sum of air bubble penetration volumes individually estimated for the plurality of penetration factors becomes equal to or greater than a predetermined volume, wherein the estimator estimates the air bubble penetration volumes according to at least two penetration factors from among a first penetration factor by which an air bubble penetrates into the ink supply line in accordance with an elapsed time since a last suction discharge operation, a second penetration factor by which an air bubble penetrates into the ink supply line when installing the ink tank with respect to the ink supply line, and a third penetration factor by which an air bubble is formed inside the ink supply line due to separating out of gas dissolved in ink.

2. The inkjet printing apparatus according to claim 1, wherein the suction discharge unit causes negative pressure to be exerted on the ejection port from the outside while an open-closed valve provided in the ink supply line is in a closed state.

3. The inkjet printing apparatus according to claim 1, wherein the estimator estimates the air bubble penetration volume according to the first penetration factor on the basis of an amount of time measured by a timer for measuring the elapsed time since the last suction discharge operation.

4. The inkjet printing apparatus according to claim 1, wherein the estimator associates a temperature change of ink inside the ink supply line, since the last suction discharge operation, with a separation volume of dissolved gas in ink inside the ink supply line, and estimates the air bubble penetration volume according to the third penetration factor on the basis of the temperature change.

5. The inkjet printing apparatus according to claim 1, wherein the estimator estimates a volume of air, inside a closed space formed between a connecting part on the side of the ink supply line and a connecting part on the side of the ink tank, that penetrates into the ink supply line as the air bubble penetration volume according to the second penetration factor.

6. The inkjet printing apparatus according to claim 5, wherein the estimator associates an amount of remaining ink inside the ink tank, which is removed from the ink supply line before installing the ink tank, with a size of the closed space, and estimates the air bubble penetration volume according to the second penetration factor on the basis of the amount of remaining ink.

7. The inkjet printing apparatus according to claim 6, wherein the amount of remaining ink and the air bubble penetration volume according to the second penetration factor have an inversely proportional relationship.

8. The inkjet printing apparatus according to claim 5, wherein the estimator associates an evaporation volume of ink, which evaporates from the connecting part on the side of the ink supply line when the ink tank is not installed with respect to the ink supply line, with a size of the closed space, and estimates the air bubble penetration volume according to the second penetration factor on the basis of the ink evaporation volume.

9. The inkjet printing apparatus according to claim 8, wherein the estimator predicts the ink evaporation volume on the basis of an amount of time measured by a timer that measures the amount of time in which the ink tank is not installed with respect to the ink supply line.

10. A method of controlling an inkjet printing apparatus that prints an image by using a print head able to eject ink, supplied from an ink tank via an ink supply line, from an ejection port, comprising steps of:

individually estimating air bubble penetration volumes due to air bubbles penetrating into the ink supply line, the estimating based on a plurality of penetration factors by which air bubbles penetrate into the ink supply line; and suctioning and discharging an air bubble inside the print head and/or inside the ink supply line by causing negative pressure to be exerted on the ejection port from the outside, when the sum of air bubble penetration volumes individually estimated for the plurality of penetration factors becomes equal to or greater than a predetermined volume, wherein the estimating step estimates the air bubble penetration volumes according to at least two penetration factors from among a first penetration factor by which an air bubble penetrates into the ink supply line in accordance with an elapsed time since a last suction discharge operation, a second penetration factor by which an air bubble penetrates into the ink supply line when installing the ink tank with respect to the ink supply line, and a third penetration factor by which an air bubble is formed inside the ink supply line due to separating out of gas dissolved in ink.

11. An inkjet printing apparatus comprising:

a print head configured to eject ink;

an ink tank configured to contain ink to be supplied to the print head and to be detachably mounted to a body of the inkjet printing apparatus;

an ink supply line configured to supply ink from the ink tank to the print head;

a suction unit configured to perform a suction operation for suctioning ink from the print head;

an estimator configured to estimate air bubble volume in the ink supply line on the basis of the elapsed time since a last suction operation and information regarding mounting of the ink tank to the body; and a control unit configured to cause the suction unit to perform the suction operation on the basis of the air bubble volume estimated by the estimator.

12. The inkjet printing apparatus according to claim 11, further comprising an open-closed valve provided in the ink supply line, wherein the suction unit causes negative pressure to suction ink from the print head while the open-closed valve is in a closed state.

13. The inkjet printing apparatus according to claim 11, wherein the estimator estimates an air bubble penetration volume penetrating into the ink supply line as the air bubble volume on the basis of the elapsed time.

14. The inkjet printing apparatus according to claim 11, wherein the estimator associates a temperature change of ink inside the ink supply line, since the last suction operation, with a separation volume of dissolved gas in ink inside the ink supply line, and estimates the air bubble volume on the basis of the temperature change.

15. The inkjet printing apparatus according to claim 11, wherein the estimator estimates a volume of air, inside a closed space formed between a connecting part on the side of the ink supply line and a connecting part on the side of the ink tank, that penetrates into the ink supply line as the air bubble volume.

16. The inkjet printing apparatus according to claim 15, wherein the estimator associates an amount of remaining ink inside the ink tank, which is removed from the ink supply line before installing the ink tank, with a size of the closed space, and estimates the volume of air on the basis of the amount of remaining ink.

17. The inkjet printing apparatus according to claim 16, wherein the amount of remaining ink and the volume of air have an inversely proportional relationship.

18. The inkjet printing apparatus according to claim 15, wherein the estimator associates an evaporation volume of ink, which evaporates from the connecting part on the side of the ink supply line when the ink tank is not installed with respect to the ink supply line, with a size of the closed space, and estimates the volume of air on the basis of the ink evaporation volume.

19. The inkjet printing apparatus according to claim 14, wherein the estimator predicts the ink evaporation volume on the basis of an amount of time measured by a timer that measures the amount of time in which the ink tank is not installed with respect to the ink supply line.

* * * * *